US006447876B1

(12) United States Patent
Robinson et al.

(10) Patent No.: US 6,447,876 B1
(45) **Date of Patent: *Sep. 10, 2002**

(54) COMPOSITE INTAKE LOUVER

(75) Inventors: John William Robinson, Fernandina Beach; David Murray McLarty, Jacksonville, both of FL (US)

(73) Assignee: Goodrich Corporation, Charlotte, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/340,952

(22) Filed: Jun. 28, 1999

(51) Int. Cl.[7] ..... F06B 7/10; B32B 3/24

(52) U.S. Cl. ..... 428/136; 428/167; 428/181; 52/656.8; 52/663; 52/473

(58) Field of Search ..... 428/136, 137, 428/181; 52/656.8, 663, 473

(56) References Cited

U.S. PATENT DOCUMENTS 3,068,536 A * 12/1962 Lieber ..... 52/473
3,217,631 A * 11/1965 Thompson et al. ..... 52/473
3,772,126 A * 11/1973 Myers ..... 156/434
3,991,533 A * 11/1976 Nagase ..... 52/473
4,244,768 A * 1/1981 Wiechowski et al. ..... 156/293
4,600,634 A * 7/1986 Langer ..... 105/220
4,680,910 A * 7/1987 Perk ..... 52/489
4,760,680 A * 8/1988 Myers ..... 52/669
5,072,561 A * 12/1991 Pitt ..... 52/473
5,286,320 A * 2/1994 McGrath et al. ..... 156/83
5,448,869 A * 9/1995 Unruh et al. ..... 52/656.1
5,641,933 A * 6/1997 Kim ..... 89/36.02
5,780,761 A * 7/1998 Mussante et al. ..... 89/36.08
5,784,741 A * 7/1998 Mangone ..... 14/73
5,987,836 A * 11/1999 Sullivan ..... 52/473

* cited by examiner

*Primary Examiner*—William P. Watkins, III
(74) *Attorney, Agent, or Firm*—Renner, Otto, Boisselle & Sklar, LLP; David M. Ronyak

(57) ABSTRACT

An improved louver is comprised of a plastic louver frame and plastic chevrons, wherein slots having the profile of the chevrons are cut into the frame, the chevrons are disposed in the slots and bonded to the frame, and a resin impregnated in glass tape is wrapped around the frame to provide further support for the frame. The louver frame is fabricated using resin infused or resin transfer-molding process and the chevrons are fabricated utilizing a pultrusion process.

10 Claims, 2 Drawing Sheets

COMPOSITE INTAKE LOUVER

TECHNICAL FIELD

The present invention relates to intake louvers for naval vessels, and more particularly, to a plastic composite intake louver for military ships.

BACKGROUND OF THE INVENTION

Louvers are Jaloosie like assemblies which permit the free flow of air from outside a ship or vessel to interior compartments. Louvers are typically comprised of a frame and a multiplicity of chevrons disposed inside the frame. The chevrons permit the free flow of air through the frame while preventing direct line of site viewing through the frame. The louvers presently utilized on military ships are made from metal and have problems with deterioration in the corrosive environment. Also metal louvers are heavy and difficult to assemble, with weight and cost being important considerations for all assemblies used on ships. Another disadvantage to current metal louvers is the fact that metal is an excellent reflector of radar signals. Since military ships prefer to have low radar visibility, metal louvers must be painted or coated with radar absorbent materials and periodically repainted as the paint wears off.

Efforts to improve such systems have lead to continuing developments to improve their versatility, practicality and efficiency. It is to be understood though that the usefulness of the present invention is not limited to military ships, or shipping in general, although it is in connection with such that the inventions here presently have usefulness. The term "invention" will be understood to be inclusive of discovery. There is a need then for a low cost louver which is lightweight and radar absorbent.

DISCLOSURE OF THE INVENTION

An object of the present invention is to provide a louver comprising a plastic frame having a plurality of plastic chevrons disposed within the frame for blocking direct line of site viewing through the frame.

Another object of the present invention is to provide a non-corrosive, lightweight louver with inherent radar absorptive capability.

According to the present invention a method of manufacturing a louver comprises the steps of:

providing a louver frame having a front, a back, a top, and a bottom;

cutting slots in the top and bottom of the louver frame;

bonding chevrons in the slots.

The present invention provides an improved louver, which is non-corrosive, lightweight, inexpensive, and radar absorptive.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principals of the invention may be employed and therefore other objects, features and advantages of the present invention will become apparent from said description and drawings.

BEST MODE FOR CARRYING OUT THE INVENTION

Figure 1:
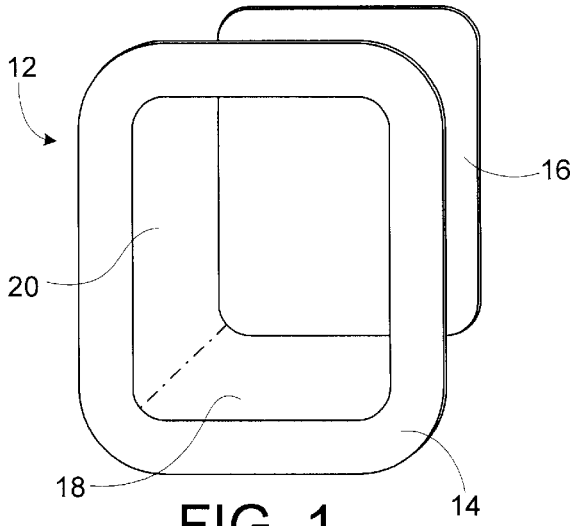
FIG. 1 is an isometric view of a louver frame in accordance with the present invention.

Referring now to the drawings wherein like reference numerals designate like or corresponding parts throughout the different views, there is shown in FIG. 1 a louver body or frame 12 having a front face 14, a rear face 16 and a body having a top, a bottom 18 and sides or sidewalls 20. The frame is preferably made as one piece from a resin infusion or resin transfer molding process. Resin infusion consists of infusing a preform with liquid resin under vacuum using a one sided tool. Resin transfer molding differs from resin infusion by infusing the preform with liquid resin under pressure with or without vacuum using a matched, two sided tool capable of withstanding the pressure. The preferred material for the louver is vinylester resin and fiberglass preform. Fillers, such as alumina trihydrate (ATH) may be utilized to generate specific properties. Other resins, such as phenolics may also be utilized. Other reinforcing fibers, such as graphite may also be utilized. The particular process and materials utilized to make the present louver components are primarily dependent upon enconomic considerations, such as the number of parts in the batch, etc.

Figure 2:
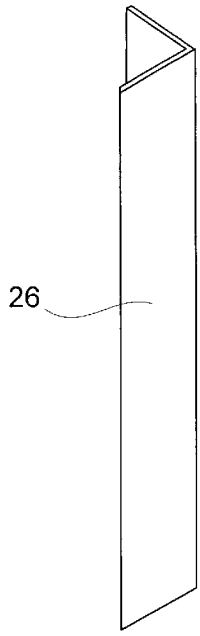
FIG. 2 is an exploded, isometric view of a chevron in accordance with the present invention.

Referring now to FIG. 2, an item utilized in the louver are chevrons 26 which resemble partly folded plastic sheets. The chevrons are bent to prevent direct line of sight viewing through the louver frame. The chevrons are not necessarily, but preferably made of the same material as the louvers. Since the chevron is not as complex a shape as the frame and has a constant cross section, it may be manufactured using a pultrusion process, because pultrusion is one of the least expensive methods for making a plastic part with a constant cross section. Pultrusion is a continuous process that consists of pulling a fiber reinforcement through a resin impregnation bath and then through a shaping die, where the resin is subsequently cured.

Figure 3:
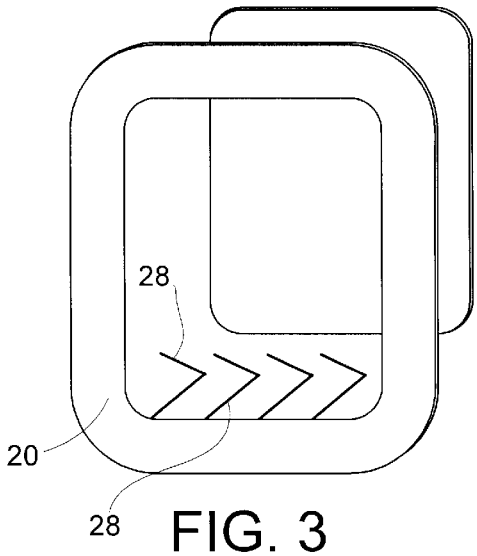
FIG. 3 is an exploded, isometric view of a louver frame after slots are cut therein in accordance with the present invention.

Referring now to FIG. 3, slots 28 having the approximate cross-section of the chevrons 26 are cut into the top and bottom of the louver frame. These slots are preferably cut using a template.

Figure 4:
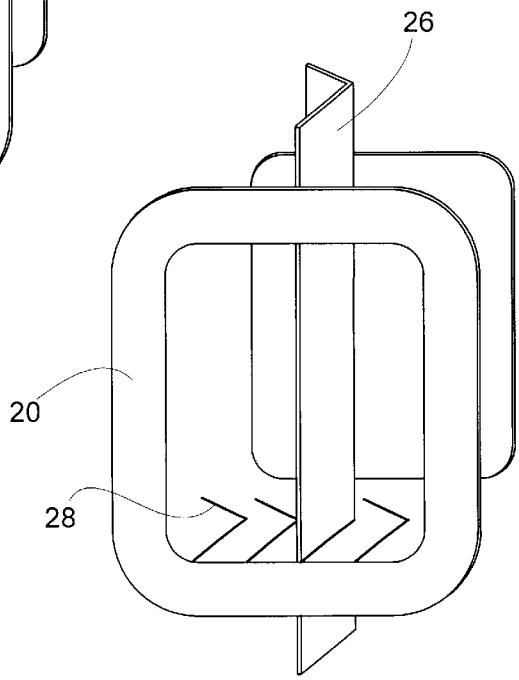
FIG. 4 is an isometric view of a louver frame having a chevron disposed therein in accordance with the present invention.

Referring now to FIG. 4, the chevrons are then inserted through the top and bottom slots 28 and bonded in place utilizing a suitable adhesive, such as Hysol 9430 available from Dexter. It can be seen that the chevrons have been manufactured with a length that is greater than the height of the louver frame. After the adhesive has cured, the chevrons can be cut to the exact size of the frames using a suitable cutting method. Manufacturing the chevrons longer than the frame height eliminates the need to precision manufacture or cut the chevrons, thereby reducing manufacturing costs since it is an easy task to cut the chevrons to length after they have been bonded in place. Bonding the chevrons into the slots improves strength and durability of the assembled louver.

Figure 5:
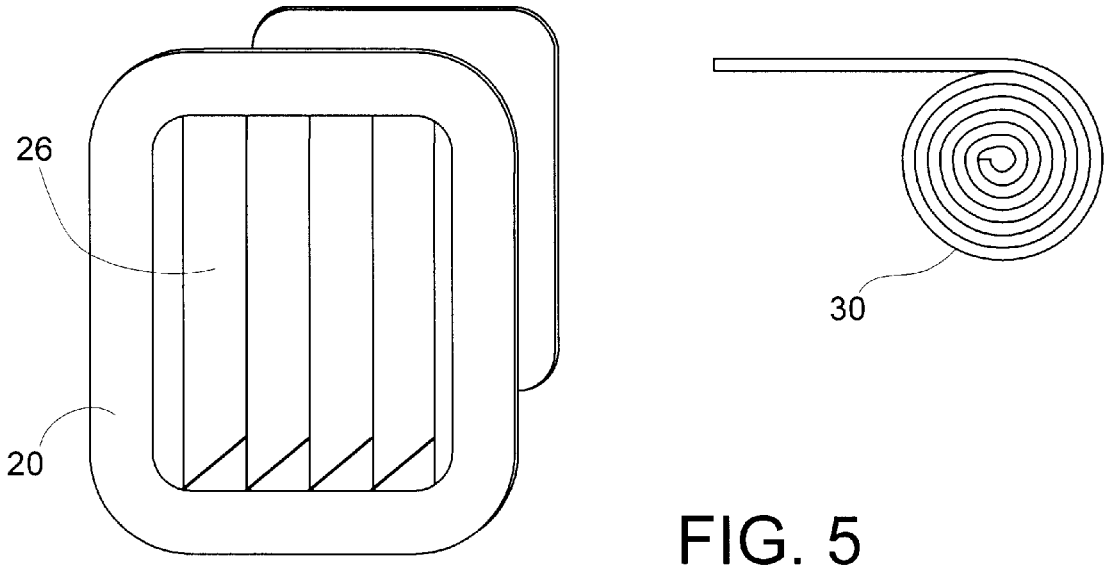
FIG. 5 is an isometric view of a louver having chevrons disposed therein in accordance with the present invention.

Referring now to FIG. 5, after the chevrons are bonded in place and cut to length, a tape wrap 30 of glass fiber impregnated with resin is wrapped around the louver frame body to further secure the chevrons in place and create the finished louver assembly. The glass/resin wrap is preferably the same fabric as the preform and the same resin used for the infusion. The wrap is then allowed to cure at room temperature in the same fashion as the louver frame. A post bake can then be used to further cure the complete louver. It is preferable to wrap the louver frame with at least two plies of resin impregnated glass to hold the chevrons in place and provide structural integrity. Other wraps, such as prepregs may be utilized for this purpose.

Figure 6:
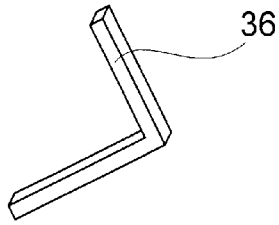
FIG. 6 is an isometric view of an insert for a lower frame in accordance with the present invention.

It is to be noted that the organic based composite louver of the present invention is non-corrosive. The louver is also capable of having inherent radar absorbing capabilities by incorporating into the plastic of the chevron and louver frame radar absorbing or magnetic attenuating materials. To this end, the preferred composition of the chevrons and louver frame is vinylester/glass composite loaded with magnetic particles. The magnetic particles should be uniformly distributed throughout the composite to prevent anistropy. Carbonyl iron or ferrites are effective for use as the magnetic particles. Referring now to FIG. 6, rather than cutting slots in the lover frame 12, resin infused inserts may be bonded to the frame near the position of the slots. The chevrons 26 would be precision cut to the proper length and placed against the inserts and bonded to the frame and inserts.

The present composite louver provides for an approximate 65% reduction in weight from the previously utilized metal louvers. Impregnating the plastic of the louvers with radar absorbing materials also keeps manufacturing and operating costs down since the previously metal louvers had to be painted with a special radar absorbing paint. Painting is a labor intensive and time consuming process.

Although the invention has been shown and described with exemplary embodiments thereof, it should be understood by those skilled in the art that the foregoing and various other changes, omissions and additions may be made therein and thereto without departing from the spirit and the scope of the invention.

What is claimed is:

1. A louver comprising:

a plastic frame having a front, a back, and opposed walls extending between the front and the back, the opposed walls each including chevron-shaped through slots aligned with respective chevron-shaped through slots in the other wall, and the front, back and opposed walls being molded as a single piece; and plastic chevrons having opposite ends thereof inserted into the slots and bonded to the plastic frame, thereby securing the chevrons to the frame.

2. A louver in accordance with claim 1, wherein the frame and chevrons are made of radar absorbing materials.

3. A louver in accordance with claim 1, further comprising a wrap disposed around the frame, the wrap extending over the slots to further secure the chevrons in place.

4. A louver in accordance with claim 1, wherein the frame and chevrons are made of vinylester.

5. A louver in accordance with claim 1, wherein the frame and chevrons are made of vinylester and fiber reinforcement.

6. A louver in accordance with claim 5, wherein the fiber reinforcement is fiberglass.

7. A louver in accordance with claim 1, wherein the plastic frame and chevrons include an alumina trihydrate (ATH) filler.

8. A louver in accordance with claim 1, wherein the frame and chevrons are made from a phenolic resin.

9. A louver in accordance with claim 3, wherein the frame and chevrons are made of vinylester and fiber reinforcement.

10. A louver in accordance with claim 9, wherein the fiber reinforcement is fiberglass.

* * * * *